US007857289B2

(12) United States Patent
Xie et al.

(10) Patent No.: US 7,857,289 B2
(45) Date of Patent: Dec. 28, 2010

(54) TAPERED BRAKING DEVICE FOR ELECTRIC WINCHES

(76) Inventors: Yuzhi Xie, 1706, No. 18, Junzi Street, Ningbo, Zhejing (CN) 315000; Kuo-Hsiang Tsao, Floor 3, No. 127, Kangle Street, Taibei, Taiwan (CN) 11487

( * ) Notice: Subject to any disclaimer, the term of this patent is extended or adjusted under 35 U.S.C. 154(b) by 27 days.

(21) Appl. No.: 12/376,876

(22) PCT Filed: Aug. 13, 2007

(86) PCT No.: PCT/CN2007/002421

§ 371 (c)(1),
(2), (4) Date: Feb. 9, 2009

(87) PCT Pub. No.: WO2008/022543

PCT Pub. Date: Feb. 28, 2008

(65) Prior Publication Data

US 2010/0163815 A1 Jul. 1, 2010

(30) Foreign Application Priority Data

Aug. 17, 2006 (CN) ..... 2006 1 0052983

(51) Int. Cl.
*B66D 1/14* (2006.01)

(52) U.S. Cl. ..... 254/351; 254/366; 254/368

(58) Field of Classification Search ..... 254/350, 254/351, 366, 368
See application file for complete search history.

(56) References Cited

U.S. PATENT DOCUMENTS 3,744,760 A * 7/1973 Uher ..... 254/351
4,625,946 A * 12/1986 Clark et al. ..... 254/274
5,261,646 A 11/1993 Telford
6,520,486 B2 2/2003 Huang
6,872,889 B1 * 3/2005 Cruttenden et al. ..... 174/69
2005/0242333 A1 * 11/2005 Peterson ..... 254/368

FOREIGN PATENT DOCUMENTS

| | | |
|---|---|---|
| CN | 2484297 | 4/2002 |
| CN | 1907838 | 2/2007 |
| CN | 2918371 | 7/2007 |

* cited by examiner

*Primary Examiner*—Emmanuel M Marcelo
(74) *Attorney, Agent, or Firm*—Dickinson Wright PLLC

(57) ABSTRACT

The present invention discloses a tapered braking device for electric winches which disposes a section of gear shaft, a section of core shaft, a wedge shape support, braking plates, an elastic element, a wedge shape piece A, a wedge shape piece B, a braking clutch base and so on in a gear box of an electric winch. When a motor works, the section of core shaft of the motor can drive the braking clutch base and the wedge shape pieces A, B to rotate, until a gap is formed between the friction faces of the wedge shape support and the wedge shape piece B and the braking plates so that the braking action stops. When the motor suddenly stops, a heavy load lifted by a tight wire rope reel provides a reverse pulling force so that the wedge shape piece B produces a reverse thrust force to push the friction faces of the braking plates, so the braking effect is achieved quickly. Based on the braking plates with the double tapered faces, the present invention can increase the braking area and the braking force and achieve safe braking. Furthermore, worn parts concentrate in the braking plates, so it only needs to replace the braking plates made of friction materials, which can simplify maintenance, reduce the costs and ensure service life of the gear box.

9 Claims, 5 Drawing Sheets

TAPERED BRAKING DEVICE FOR ELECTRIC WINCHES

CROSS-REFERENCE TO RELATED APPLICATIONS

This application is a National Stage of International Application No. PCT/CN2007/002421, filed Aug. 13, 2007. This application claims the benefit and priority of Chinese Application No. 200610052983.9, filed Aug. 17, 2006. The entire disclosure of each of the above applications is incorporated herein by reference.

FIELD OF THE INVENTION

The present invention relates to a braking device, and more particularly to a tapered braking device for electric winches.

DESCRIPTION OF THE PRIOR ART

Electric brakes pull goods via reeling tight wire rope for self-aid and buddy aid in automobile accidents in the fields. For avoiding stall of tight wire rope caused by sudden power cut during retracting, braking devices are disposed for ensuring safe operation. Chinese Patent No. 01229143.9 discloses a braking device for power winches which includes a gear box, a braking cover, a section of gear shaft, a section of core shaft extending from a motor shaft, a wedge shape piece A, a wedge shape piece B, a braking clutch base, an elastic element, a braking plate and so on. The braking device uses the section of core shaft extending from the motor shaft to drive the braking clutch base to rotate. Inner double flanges in the braking clutch base simultaneously drive the wedge shape piece A and the wedge shape piece B to rotate. At this time, the braking plate on the wedge shape piece B and a friction tapered face of the gear box still keep a gap therebetween, so the braking device is in a non-braking state. When the motor suddenly stops, the inertia of the braking clutch base causes that the wedge shape piece B moves axially while rotating to drive the braking plate to achieve the single tapered face braking for the gear box. However, the braking device has the shortcomings that the braking area and the braking force produced by the single tapered face braking is small, which will easily cause slipping phenomena, and more chiefly the braking plate directly acts on the tapered face of the gear box, which will easily make the tapered face to be wearing directly, so that the tapered face lose braking efficacy.

Then the gear box must be replaced, which causes difficult maintenance and high replacement cost of parts.

SUMMARY OF THE INVENTION

An object of the present invention is to provide a tapered braking device for electric winches which has the advantages of larger braking area, good braking effects, lower replacement cost of parts and avoiding wearing a gear box directly.

To achieve the above-mentioned object, a tapered braking device for electric winches in accordance with the present invention is disclosed.

A tapered braking device for electric winches includes: a gear box fixed on the electric winch; a braking cover fixedly connected with the gear box; a section of hollow gear shaft inserted in a shaft hole of the gear box and supported by a bearing; a section of core shaft extending from a motor shaft and passing through the hollow gear shaft, wherein one extended end portion of the core shaft which extends out of the hollow gear shaft is a polyhedron; a wedge shape piece A setting on the gear shaft and engaging with the gear shaft, wherein a left end face of the wedge shape piece A is a cam face formed by double tapered faces, a right end face of the wedge shape piece A is axially limited by a C-ring, and outer double flange structure is arranged with homogeneous distribution on the outer surface along a circumference of the wedge shape piece A; a wedge shape piece B setting on the hollow gear shaft and still keeping a gap therebetween, wherein a right end face of the wedge shape piece B is a cam face formed by double tapered faces which engage with the wedge shape piece A, an outer double flange structure is arranged with homogeneous distribution on the outer surface along a circumference of the wedge shape piece B, and a plurality of braking plates are disposed on an outer edge of the wedge shape piece 13 and each has a double tapered face structure and forms a double tapered friction face with the wedge shape support which sets on the hollow gear shaft and will rotate along with the hollow gear shaft and the wedge shape piece B which sets on the hollow gear shaft; an elastic element, setting on the gear shaft and abutting against the wedge shape piece B; and a braking clutch base having a center setting on the end portion of the section of core shaft and combined with the polyhedron of the end portion, wherein a bearing supports between the braking clutch base and the braking cover, and an inner double flange structure is formed on an inner surface of the braking clutch base, matching with the outer double flange structures of the wedge shape piece A and the wedge shape piece B, to push the outer double flange structure of the wedge shape piece A to rotate thereby pushing the wedge shape piece B to move axially.

A ring groove is formed in a left end face of the wedge shape piece B to receive the elastic element.

The number of the braking plates with the double tapered face structures which are arranged along the circumference of the wedge shape piece B is 4-8.

Outer round surfaces of the wedge shape support and the wedge shape piece B have opposite tapered faces, and the wedge shape support and the wedge shape piece B forms the double tapered friction faces, which form a double tapered friction face contacting with each other or being detached from each other with the braking plates along circumferences of the wedge shape support.

The elastic element is a pagoda-shaped left-hand spring and disposed between the wedge shape support and the wedge shape piece B, one end of the elastic element fastened in a hole of the section of gear shaft and the other end thereof fastened in a hole of the ring groove of the wedge shape piece B.

A reverse turning force exists between the wedge shape piece B and the elastic element.

The wedge shape support is made of wear resistant alloy steel. The hollow gear shaft has a multikey structure.

The polyhedron is a hexahedron.

Comparing with the prior art, the present invention uses the friction braking of the double tapered faces to replace the friction braking of the single tapered face, and there is no friction braking existing between the braking plates and the gear box.

The optimal material selection for the wedge shape support and the wedge shape piece B can ensure that the friction wear faces concentrate in the braking plates and the braking area is doubled, so the braking force increases and the braking is safe. Additionally, when the braking wear is serious, it only needs to replace the braking plates made of friction materials, which can simplify maintenance and reduce the costs greatly.

DETAILED DESCRIPTION OF THE INVENTION

Figure 1:
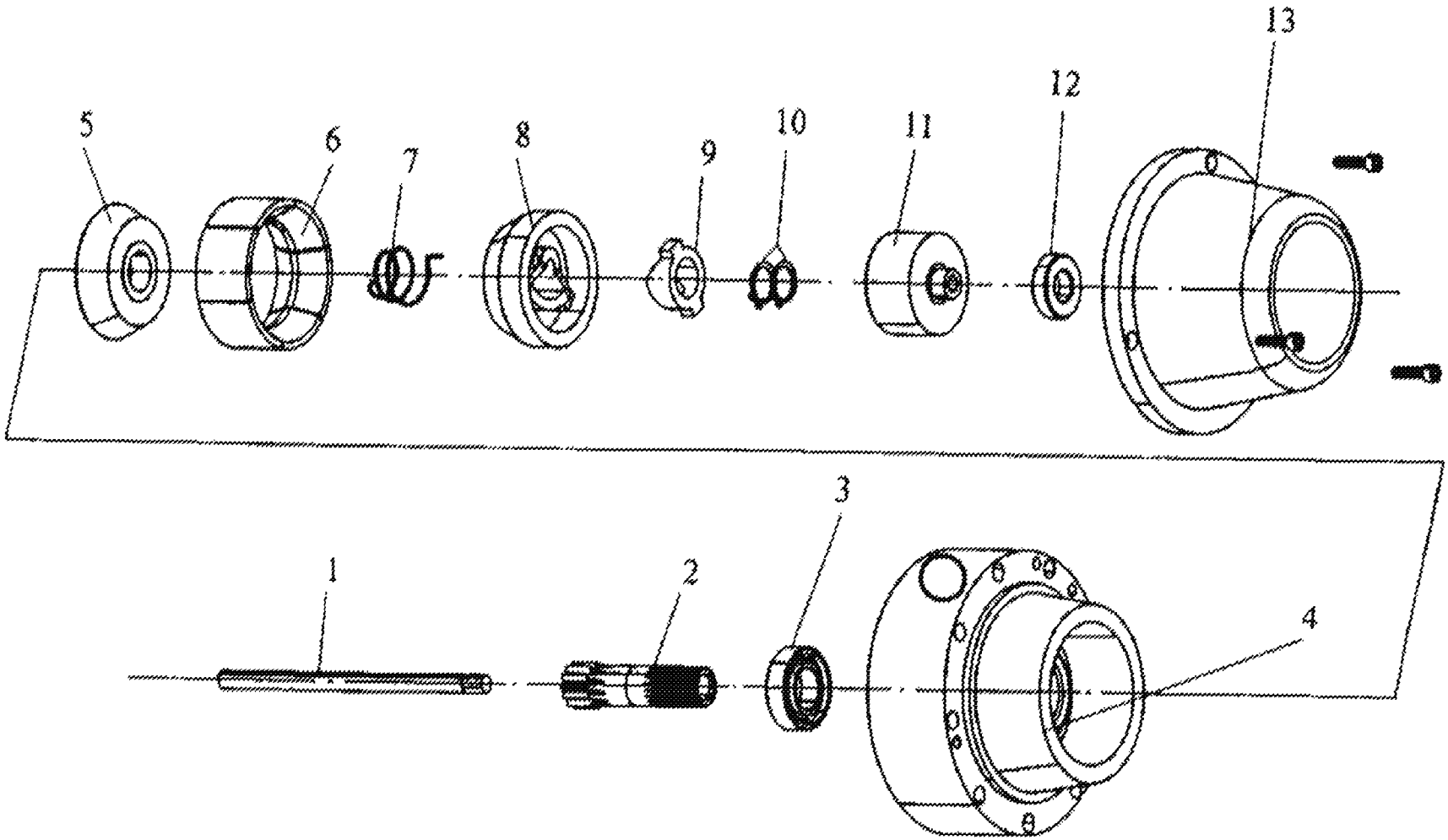
FIG. 1 is an exploded perspective view of a tapered braking device for electric winches according to the present invention.

The following is the detailed description of the embodiment of the present invention in connection with the appended drawings.

As shown in FIGS. 1-10, a tapered braking device for electric winches according to the present invention includes a gear box 4 fixed on an electric winch, a braking cover 13 fixedly connected with the gear box 4, and a section of hollow gear shaft 2 which extends into the center of the gear box 4 and is supported by a bearing 3. The hollow gear shaft 2 has a multikey structure. A section of core shaft 1 extending from a motor shaft passes through the hollow gear shaft 2, and one extended end portion of the core shaft 1 which extends out of the hollow gear shaft 2 is a hexahedron 18. Besides the bearing 3, a wedge shape support 5, an elastic element 7, a wedge shape piece B 8 and a wedge shape piece A 9 respectively sets on the section of gear shaft 2 from left to right.

Outer surfaces of the wedge shape support 5 and the wedge shape piece B 8 have opposite tapered faces. Six pieces of braking plates 6 are disposed in the gear box 4 and each has a double tapered face structure. Double tapered friction faces are formed between the wedge shape support 5 and the wedge shape piece B 8 and the six braking plates 6 along the circumferences of the wedge shape support 5 and the wedge shape piece B 8 and the six braking plates 6. Based on the double tapered friction faces, the wedge shape support 5 and the wedge shape piece B 8 and the six braking plates 6 contact with each other or are detached from each other with friction.

The elastic element 7 is a pagoda-shaped left-hand spring and disposed between the wedge shape support 5 and the wedge shape piece B 8, one end fastened in a hole of the section of gear shaft 2 and the other end fastened in a hole of a ring groove 17 of the wedge shape piece B. The wedge shape support 5 and the wedge shape piece B 8 are made of wear resistant alloy steel. The elastic element 7 is convenient for pushing the wedge shape piece B when there is no need of braking, so that a gap can be formed between the tapered faces of the wedge shape support and the wedge shape piece B and the double tapered faces of the braking plates (as shown in FIGS. 2-5). During assembly, the elastic element 7 is compressed to produce a reverse thrust force for pushing the braking plates located on the tapered friction face of the wedge shape piece B far away from the friction faces, so it needs a proper turning force existing between the wedge shape piece B 8 and the elastic element 7, that is, when the two ends of the elastic element 7 are respectively fastened in the holes, the wedge shape piece B 8 needs to has a proper reverse turning force relative to the elastic element 7.

Figure 7:
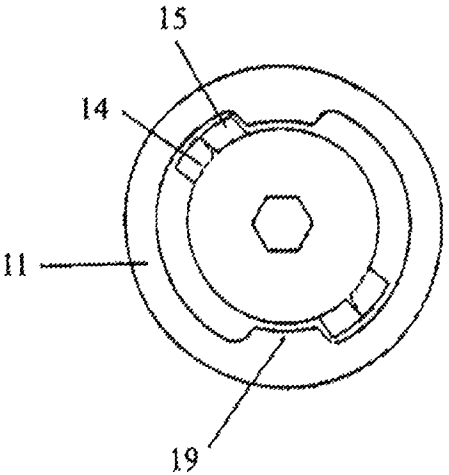
FIG. 7 is a schematic view showing a relative position of the braking clutch base and the wedge shape pieces A, B when the present invention is in a clockwise rotation and braking state.
Figure 8:
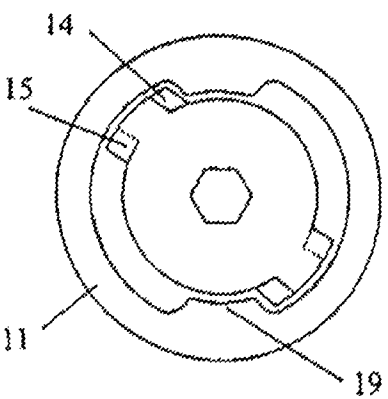
FIG. 8 is a schematic view showing a relative position of the braking clutch base and the wedge shape pieces A, B when the present invention is in an anticlockwise rotation and braking state.
Figure 6:
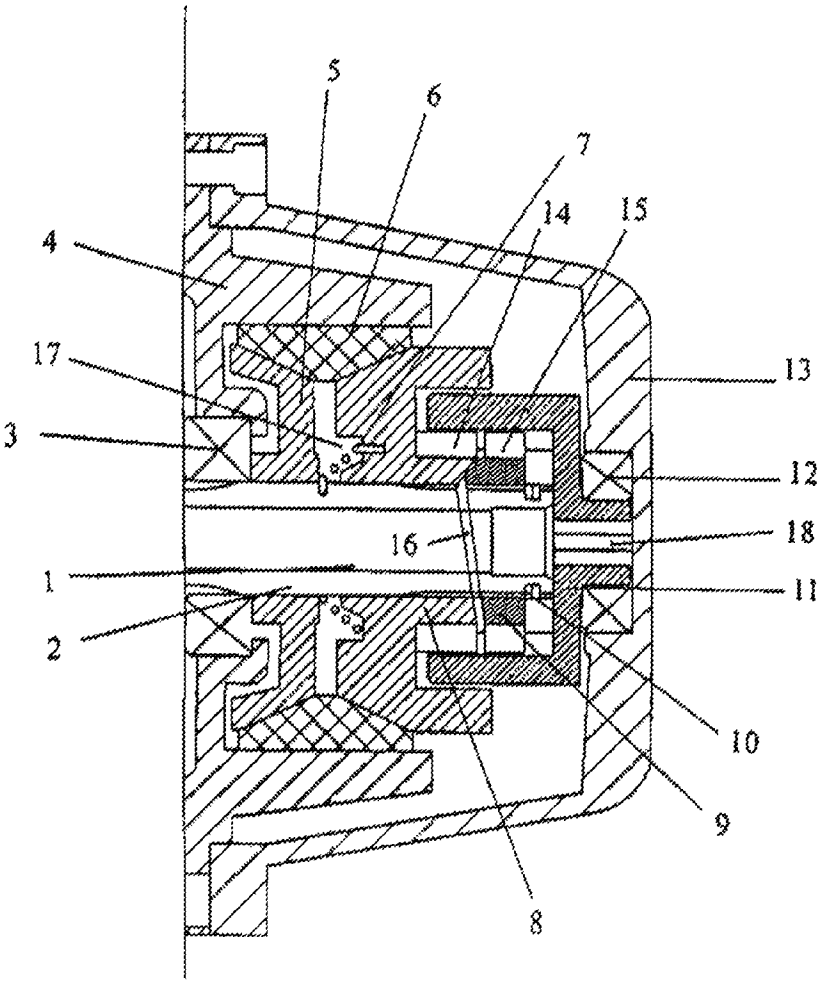
FIG. 6 is a structural view of the present invention, in a braking state.
Figure 10:
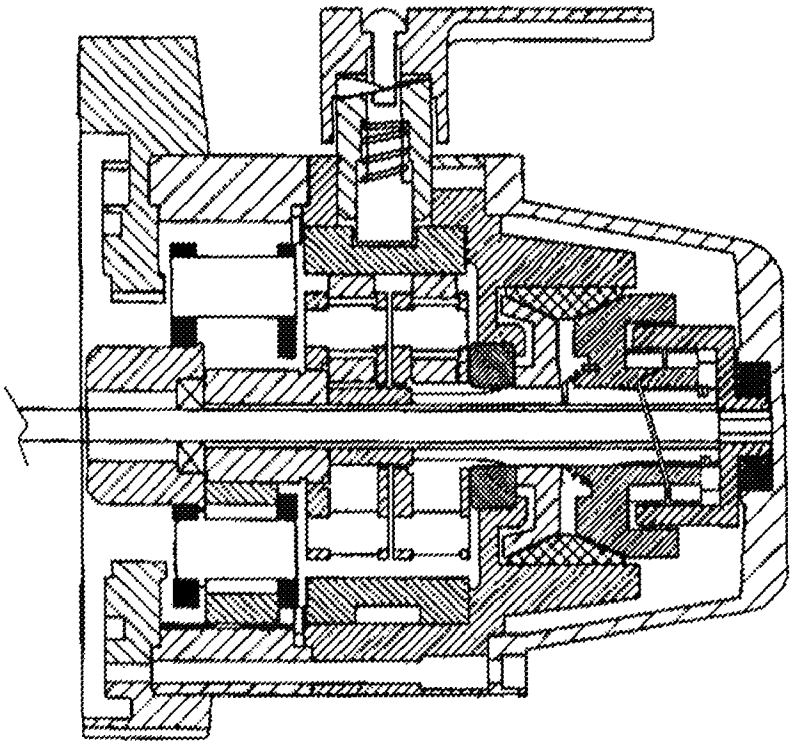
FIG. 10 is a schematic view showing a relative position of the present invention and the clutch device in an engaging state in the electric winch mechanism.
Figure 9:
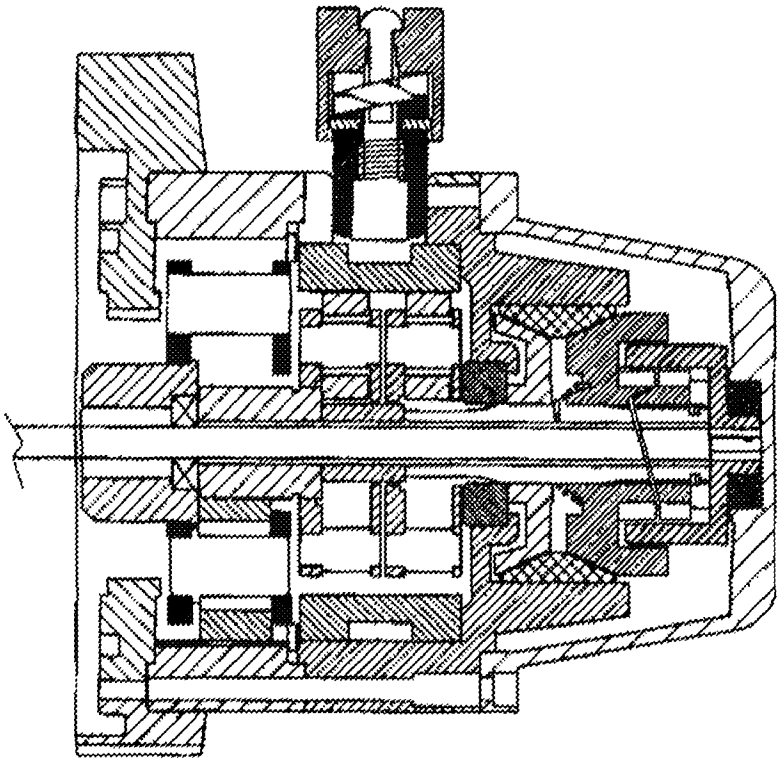
FIG. 9 is a schematic view showing a relative position of the present invention and a clutch device in a disengaging state in an electric winch mechanism.

The section of gear shaft 2 passes through a shaft hole of the wedge shape piece B 8 with gap therebetween, and there is no direct transmission relation between the wedge shape piece B 8 and the section of gear shaft 2. An inner hole of the wedge shape piece A 9 is a splined gear hole which can engage with splined teeth of the section of gear shaft 2 thereby forming a direct transmission relation therebetween, and at the same time, the wedge shape piece A 9 is axially limited by a group of C-shaped C-rings in order to prevent the wedge shape piece A from moving. Combination end faces of the wedge shape piece B and the wedge shape piece A are cam faces 16 formed by double-inclined-faces. When the cam faces of the wedge shape piece B and the wedge shape piece A are combined with each other, the mechanism is in a non-braking state; and when the cam faces of the wedge shape piece B and the wedge shape piece A, which are formed by double-inclined-faces, are detached from each other, the wedge shape piece A pushes the wedge shape piece B to move axially towards the left so that the mechanism is in a braking state where the mechanism abuts against the braking plates (as shown in FIGS. 6-8). Outer double flange structures 15, 14 are respectively arranged with homogeneous distribution on the outer surface of the wedge shape piece A and the wedge shape piece B along the circumferences of the wedge shape piece A and the wedge shape piece B.

A braking clutch base 11 has a center shaft hole which is a hexahedral hole. The braking clutch base 11 sets on the hexahedron 18 of the end portion of the section of core shaft 1 and has a direct driving relation with the section of core shaft 1. The bearing 12 supports between the braking clutch base 11 and the braking cover 13. The braking clutch base 11 has an inner double flange structure 19 arranged along the circumference thereof (as shown in FIG. 3, FIG. 5, FIG. 7, FIG. 8), matching to the outer double flange structures of the wedge shape piece A and the wedge shape piece 13. When the section of core shaft 1 is driven by a motor shaft, the braking clutch base 11 rotates along with the section of core shaft 1 (clockwise or anticlockwise), and the inner double flanges 19 in the braking clutch base 11 push the outer double flanges 15 of the wedge shape piece A 9 so that the wedge shape piece A rotates along with the braking clutch base 11, thereby the section of gear shaft can be driven to rotate synchronously by the wedge shape piece A. At the same time, the braking clutch base 11 immediately pushes the inner double flanges 19 to the outer double flanges 14 of the wedge shape piece B to drive the wedge shape piece B to rotate.

Figure 3:
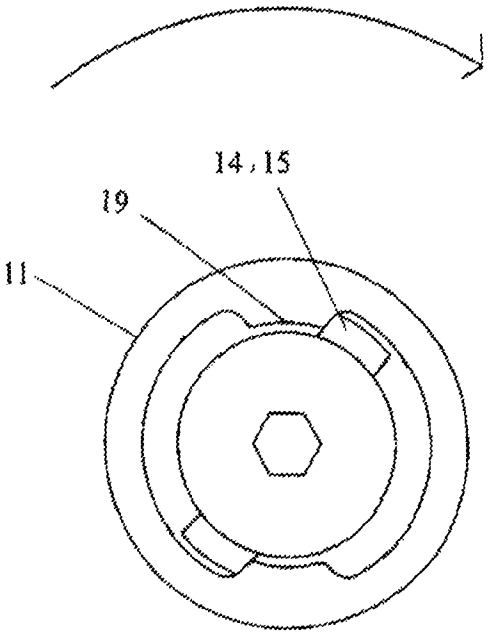
FIG. 3 is a schematic view showing a relative position of a braking clutch base and wedge shape pieces A, B when the present invention is in the clockwise rotation and non-braking state.
Figure 2:
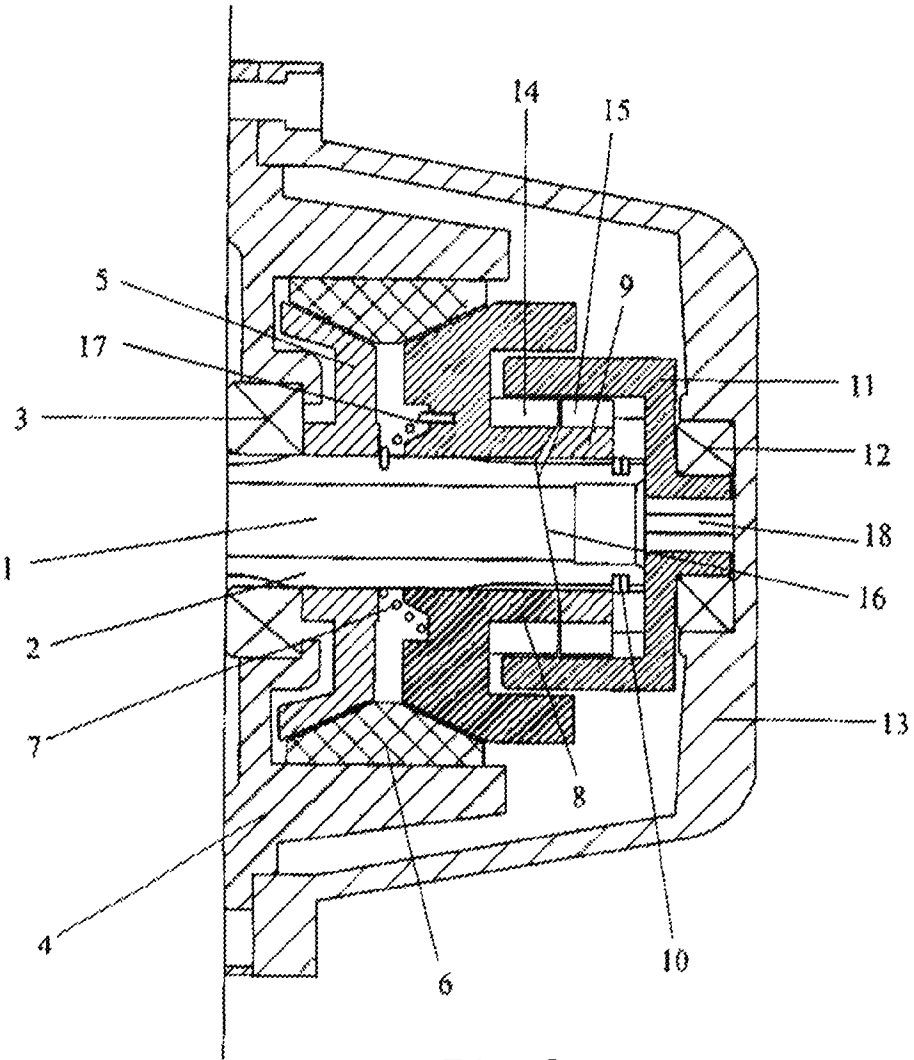
FIG. 2 is a structural view of the present invention, in a clockwise rotation and non-braking state.
Figure 4:
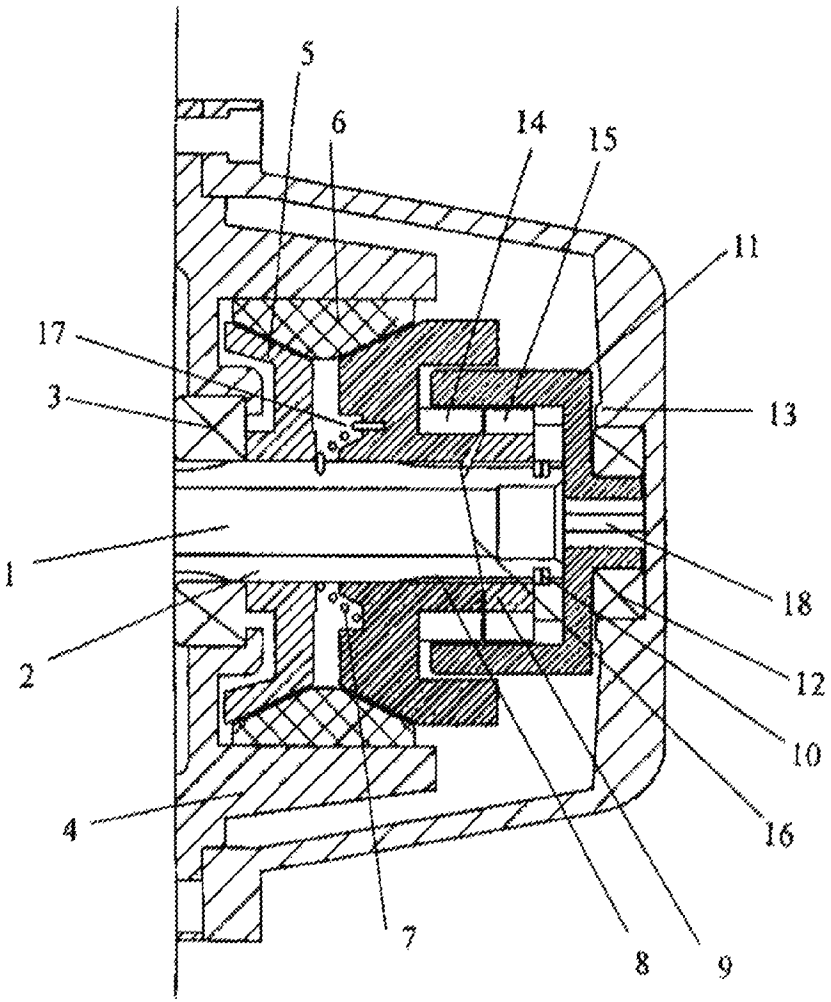
FIG. 4 is a structural view of the present invention, in an anticlockwise rotation and non-braking state.

When a heavy load needs to be lifted, users can press a clockwise press button so that the motor core shaft rotates clockwise. When the motor drives its core shaft to rotate, the braking clutch base is driven immediately and the inner double flanges in the braking clutch base are pushed to abut against the outer double flanges of the wedge shape piece A and the outer double flanges of the wedge shape piece B, so that the wedge shape pieces A, B can be synchronously driven to rotate (as shown in FIGS. 2-3). At this time, the wedge shape piece A drives the section of gear shaft to rotate synchronously, so the section of gear shaft comes back to engage with the above-mentioned deceleration gear group (not shown), thereby driving a tight wire rope reel to rotate to reel up a tight wire rope. Accordingly, the heavy load is lifted. At the same time, since the wedge shape piece B is also driven so that the angle difference between the wedge shape piece A and the wedge shape piece B disappears, the gentler cam inclined face of the wedge shape piece B is close to that of the wedge shape piece A (as shown in FIGS. 2-3), and the rotation force of the gentler cam inclined face is greater than a reverse twisting force on the wedge shape piece B, and besides, the reverse thrust force of the elastic element has an effect on the wedge shape piece B, the wedge shape piece B moves towards the right (as shown in FIG. 2 and FIG. 4). Accordingly, the braking plates are detached from the friction faces, and the heavy load can be lifted successfully. When the motor stops transferring power, the motor core shaft and the braking clutch base thereupon stop rotating, so the inner double flanges 19 in the braking clutch base 11 stop pushing the outer double flanges 14, 15. At this time, a twisting force produced under the gravity of the heavy load pulls the tight wire rope reel to turn back through the tight wire rope and is transmitted to the core shaft 1 and the wedge shape piece A via the deceleration gear group so that the core shaft 1 and the wedge shape piece A are desired to turn back. In fact, the wedge shape piece A really turns back for a very small distance and then stops. So the angle difference between the wedge shape piece B and the wedge shape piece A instantly appears, and the steeper inclined face of the wedge shape piece A is pushed to that of the wedge shape piece B, and besides, the reverse twisting force of the elastic element has the effect on the wedge shape piece B, the wedge shape piece B has to move towards the left (as shown in FIG. 7 and FIG. 8), thereby instantly producing a braking effect of contact friction of the braking plates and friction faces. Furthermore, the greater the twisting force of the heavy load is, the greater the push force that the wedge shape piece A exerts on the wedge shape piece B is, so the braking force produced by the contact friction is greater.

Figure 5:
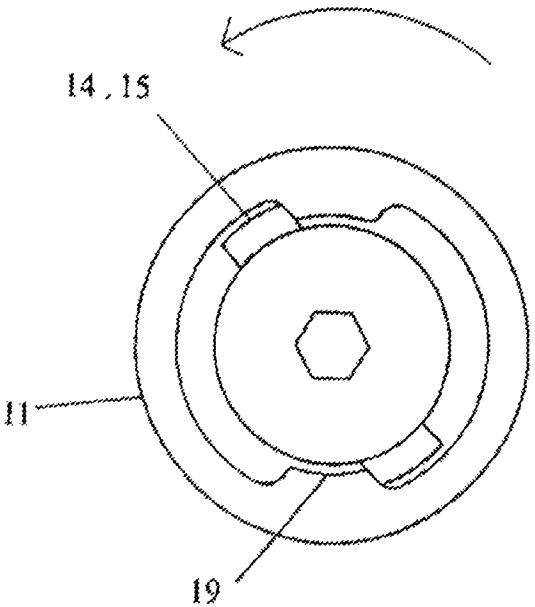
FIG. 5 is a schematic view showing a relative position of the braking clutch base and the wedge shape pieces A, B when the present invention is in the anticlockwise rotation and non-braking state.

The braking effect produced in the process of lifting the heavy load to a higher position is described above. In another process that the heavy load is lowered from a higher position to a lower position, when the heavy load has been lifted to the end of the tight wire rope and hung in the air, the braking effect, which is described above and produced when the power is off, as shown in FIG. 7 and FIG. 8, is firstly produced. Then users can operate the motor so that the motor rotates anticlockwise, so the motor core shaft and the braking clutch base all rotate anticlockwise. Instantly, the inner double flanges in the braking clutch base push the outer double flanges of the wedge shape piece B and then the outer double flanges of the wedge shape piece A (as shown in FIGS. 4-5), so the angle difference between the wedge shape piece B and the wedge shape piece A disappears, and the gentler cam inclined face of the wedge shape piece B is close to that of the wedge shape piece A again (as shown in FIG. 4). Accordingly, the tapered face of the wedge shape piece B is detached from the friction faces of the braking plates, and the heavy load can be lowered successfully. Comparing FIG. 4 with FIG. 5, when the heavy load is lifted and lowered under power, the wedge shape piece B always moves towards the right slightly and stops braking. When the motor stops, the braking effect as shown in FIG. 8 is achieved quickly. Besides, there also exists the braking effect when the heavy load isn't lifted or lowered and the power is off.

Accordingly, the present invention has the braking effect after assembly. Once the motor works (clockwise or anticlockwise), the braking effect disappears; and when the power is off or cut suddenly, the braking affect is instantly produced, and the heavier the heavy load is, the greater the braking force is, thereby ensuring safe and convenient use.

What is claimed is:

1. A tapered braking device for electric winches, comprising:

a gear box (4), fixed on the electric winch;

a braking cover (13), fixedly connected with the gear box;

a section of hollow gear shaft (2), inserted in a shaft hole of the gear box and supported by a bearing;

a section of core shaft (1), extending from a motor shaft and passing through the hollow gear shaft, wherein one extended end portion of the core shaft which extends out of the hollow gear shaft is a polyhedron;

a wedge shape piece A (9), setting on the hollow gear shaft (2) and engaging with the hollow gear shaft, wherein a left end face of the wedge shape piece A is a cam face (16) formed by double tapered faces, a right end face of the wedge shape piece A is axially limited by a C-ring (10), and outer double flange (14) structure is arranged on the outer surface along a circumference of the wedge shape piece A;

a wedge shape piece B (8), setting on the hollow gear shaft (2) and still keeping a gap therebetween, wherein a right end face of the wedge shape piece B is a cam face (16) formed by double tapered faces which engage with the wedge shape piece A, an outer double flange (14) structure is arranged on the outer surface along a circumference of the wedge shape piece B, and a plurality of braking plates (6) are disposed on an outer edge of the wedge shape piece B;

an elastic element (7), setting on the section of hollow gear shaft (2) and abutting against the wedge shape piece B (8); and a braking clutch base (11), having a center setting on the end portion of the section of core shaft (1) and combined with the polyhedron of the end portion, wherein a bearing supports between the braking clutch base (11) and the braking cover (13), and an inner double flange (19) structure is formed on an inner surface of the braking clutch base (11), matching with the outer double flange structures of the wedge shape piece A and the wedge shape piece B, to push the outer double flange structure of the wedge shape piece A to rotate thereby pushing the wedge shape piece B to move axially; wherein the braking plates (6) has a double tapered face structure and forms a double tapered friction face with a wedge shape support (5) which sets on the hollow gear shaft and will rotate along with the hollow gear shaft and the wedge shape piece B (8) which sets the hollow gear shaft (2).

2. The tapered braking device for electric winches as claimed in claim 1, wherein a ring groove (17) is formed in a left end face of the wedge shape piece B (8) to receive the elastic element (7).

3. The tapered braking device for electric winches as claimed in claim 2, wherein the elastic element (7) is a pagoda-shaped left-hand spring and disposed between the wedge shape support (5) and the wedge shape piece B (8), one end of the elastic element (7) fastened in a hole of the section of gear shaft (2) and the other end thereof fastened in a hole of the ring groove (17) of the wedge shape piece B (8).

4. The tapered braking device for electric winches as claimed in claim 3, wherein a reverse turning force exists between the wedge shape piece B (8) and the elastic element (7).

5. The tapered braking device for electric winches as claimed in claim 1, wherein the number of the braking plates (6) with the double tapered face structures which are arranged along the circumference of the wedge shape piece B is 4-8.

6. The tapered braking device for electric winches as claimed in claim 5, wherein outer round surfaces of the wedge shape support (5) and the wedge shape piece B (8) have opposite tapered faces, which form a double tapered friction face contacting with each other or being detached from each other with the braking plates (6) along circumferences of the wedge shape support (5).

7. The tapered braking device for electric winches as claimed in claim 1, wherein the wedge shape support (5) is made of wear resistant alloy steel.

8. The tapered braking device for electric winches as claimed in claim 1, wherein the hollow gear shaft (2) has a multikey structure.

9. The tapered braking device for electric winches as claimed in claim 1, wherein the polyhedron is a hexahedron.

* * * * *

UNITED STATES PATENT AND TRADEMARK OFFICE

CERTIFICATE OF CORRECTION

PATENT NO. : 7,857,289 B2
APPLICATION NO. : 12/376876
DATED : December 28, 2010
INVENTOR(S) : Yuzhi Xie and Kuo-Hsiang Tsao It is certified that error appears in the above-identified patent and that said Letters Patent is hereby corrected as shown below:

Title Page, Item (75) first Inventor's address: "Ningbo, Zhejing" should read -- Ningbo, Zhejiang --

Column 2, Line 15: "wedge shape piece 13" should read -- wedge shape piece B --

Signed and Sealed this
Twenty-second Day of February, 2011

David J. Kappos

David J. Kappos
*Director of the United States Patent and Trademark Office*